US006099330A

United States Patent [19]

Gundermann et al.

[11] Patent Number: 6,099,330

[45] Date of Patent: Aug. 8, 2000

[54] CONNECTOR WITH LEVER

[76] Inventors: James E. Gundermann, 114 Russell St., Warren, Pa. 16365; Hans Jost Heimüller, AM Schafgarten 9, 67373 Dudenhofen, Germany; Michael Bonavita, R.D. 1, Box 1163, Russell, Pa. 16345

[21] Appl. No.: 09/313,875

[22] Filed: May 18, 1999

Related U.S. Application Data

[60] Provisional application No. 60/094,621, Jul. 30, 1998, and provisional application No. 60/094,622, Jul. 30, 1998.

[51] Int. Cl.[7] ..... H01R 13/62

[52] U.S. Cl. ..... 439/157; 439/372

[58] Field of Search ..... 439/157, 152–156, 439/158–160, 372, 341

[56] References Cited

U.S. PATENT DOCUMENTS

| | | | |
|---|---|---|---|
| 3,300,751 | 1/1967 | Fraley | 339/91 |
| 5,135,410 | 8/1992 | Kawase et al. | 439/157 |
| 5,172,998 | 12/1992 | Hatagishi | 403/27 |
| 5,230,635 | 7/1993 | Takenouchi et al. | 439/157 |
| 5,322,383 | 6/1994 | Saito et al. | 403/321 |
| 5,476,390 | 12/1995 | Taguchi et al. | 439/157 |
| 5,564,935 | 10/1996 | Yagi et al. | 439/157 |
| 5,722,843 | 3/1998 | Kerckhof et al. | 439/157 |

*Primary Examiner*—Gary F. Paumen
*Assistant Examiner*—Tho D. Ta
*Attorney, Agent, or Firm*—William H. McNeill

[57] ABSTRACT

A connector assembly is provided which includes first and second connector housings. In order to facilitate complete mating of the housings, a lever is supported by the first housing. Pivotal movement of the lever causes gear-like elements associated with the lever and the second housing to urge the housings together. The lever is external of the connector assembly and the gear-like elements are internal thereof. The lever engages the first housing in such a manner as to prevent rotation of the lever until camming elements associated with the lever engage camming elements associated with the second housing.

20 Claims, 8 Drawing Sheets

CONNECTOR WITH LEVER

This application claims priority from Provisional Application Nos. 60/094,621 and 60/094,622, filed Jul. 30, 1998.

TECHNICAL FIELD

The present invention relates to a connector assembly, and more particularly to a connector assembly which includes a male connector housing and a female connector housing which are slidably engageable. A lever is pivotally supported by one of the connector housings to facilitate engagement and disengagement thereof. Operation of the lever mechanically assists the mating of the connector housings to overcome high insertion force.

BACKGROUND ART

The mating of male and female connectors to form a connector assembly often involves a high insertion force. This is particularly true when the connectors comprise mating connector housings containing many contacts. For example, automobile wiring systems typically include wiring harnesses. Each harness contains many conductors which are electrically and mechanically connected to respective contacts contained in the harness connector housing. The harness connector housing and the plurality of contacts contained therein are mated with a header connector housing and the contacts contained therein. In such applications, the mating of the harness and header connector housings is often difficult due to the force required to overcome the friction between the mating contacts.

Many attempts have been made using levers to overcome high insertion force when mating male and female connector housings. Some attempts have required that the lever includes slits or grooves therein or therethrough which engage pins which extend outwardly from one of the connector housings. Such slits or grooves tend to weaken the lever as well as cause more flexing thereof during use than desired. Some attempts require that the pivoting and camming elements be located on the outside of the connector assembly. The use of pivoting and camming elements external of the connector assembly is undesirable. Such pivot and camming elements prevent a smooth seal and therefore are not useful in a sealed connector environment. Another problem incurred is that there is a tendency in some connector assemblies for the lever to prematurely rotate out of the desired assembly position. A further concern is that in those applications wherein multiple connectors are stacked upon each other, there is a tendency for the latch, which secures the lever in place when the connector housings are mated, to fail.

An example of one prior art connector assembly is U.S. Pat. No. 5,322,383 which issued on Jun. 21, 1994 to Saito et al. This patent relates to a lever-type connector including two housings wherein a lever is pivotally connected by pivot shafts to one of the housings to provide leverage during mating of the two. In such embodiment, it is necessary to provide cam grooves in opposing inner surfaces of the lever. The grooves mate with respective guide pins to facilitate engagement of the connectors. A similar device is described in U.S. Pat. No. 5,172,998 which issued on Dec. 22, 1992 to Hatagishi. In the Hatagishi embodiment, opposing cam slits extend completely through the lever.

In U.S. Pat. No. 3,300,751 which issued on Jan. 24, 1967 to Fraley, a lever is provided to facilitate the mating of connector elements, such lever including a slot which extends through the lever. The lever is attached to a top plate by a screw extending outwardly of a top section of the top plate. Another screw mates with the slot to facilitate movement of the connector elements. Each screw is external of the device.

In U.S. Pat. No. 5,564,935 which issued on Oct. 15, 1996 to Yagi et al., a connector engagement device is illustrated which includes two lever-type cam members pivoted upon respective externally extending pins. Each cam member includes cam grooves which mate with externally extending pins. The cam members are also provided with teeth which mesh so that the two cam members can be operated to interlock with each other in directions different from each other.

DISCLOSURE OF THE INVENTION

It is an object of the present invention to provide an improved connector assembly.

Another object of the present invention is to obviate the disadvantages of the prior art.

A further object of the present invention is to provide a connector assembly which includes a lever which is mounted externally of mated connector housings and camming features which are located within the connector assembly.

Yet another object of the present invention is to provide a connector assembly which includes a lever which is mounted externally of mated connector housings and lever pivot elements which do not extend outwardly from the connector assembly.

Another object of the present invention is to provide a connector assembly which includes a lever which does not include camming features in the form of grooves or slits therein or therethrough.

Yet another object of the present invention is to provide a connector assembly which includes a lever which will not rotate prematurely out of the desired assembly position.

Another object of the present invention is to provide a connector assembly which may be stacked with one or more other connector assemblies without failure of the latch which secures the lever in place when mating connector housings are fully engaged.

The present invention achieves these and other objects by providing, in one aspect of the invention, a connector assembly which includes at least one first connector housing and at least one second connector housing slidably engaging within the first connector housing. The second connector housing comprises a first and second cam projection. A lever is pivotally supported on the first connector housing by at least one pivot element extending through a wall of the first connector housing. The lever comprises at least one lever portion adapted (a) to engage a wall of the first connector housing in a first lever position to prevent pivotal movement of the lever, and (b) to be disengaged from the wall of the first connector housing by a first cam projection in a second lever position to permit pivotal movement of the lever. The pivot element comprises a first region which comprises a cam follower adapted to engage a second cam projection in an engagement and disengagement mode when the lever is pivoted in an engagement direction or in an opposite disengagement direction, respectively, to urge the first and second connector housings towards or away from each other, respectively.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

Figure 1:
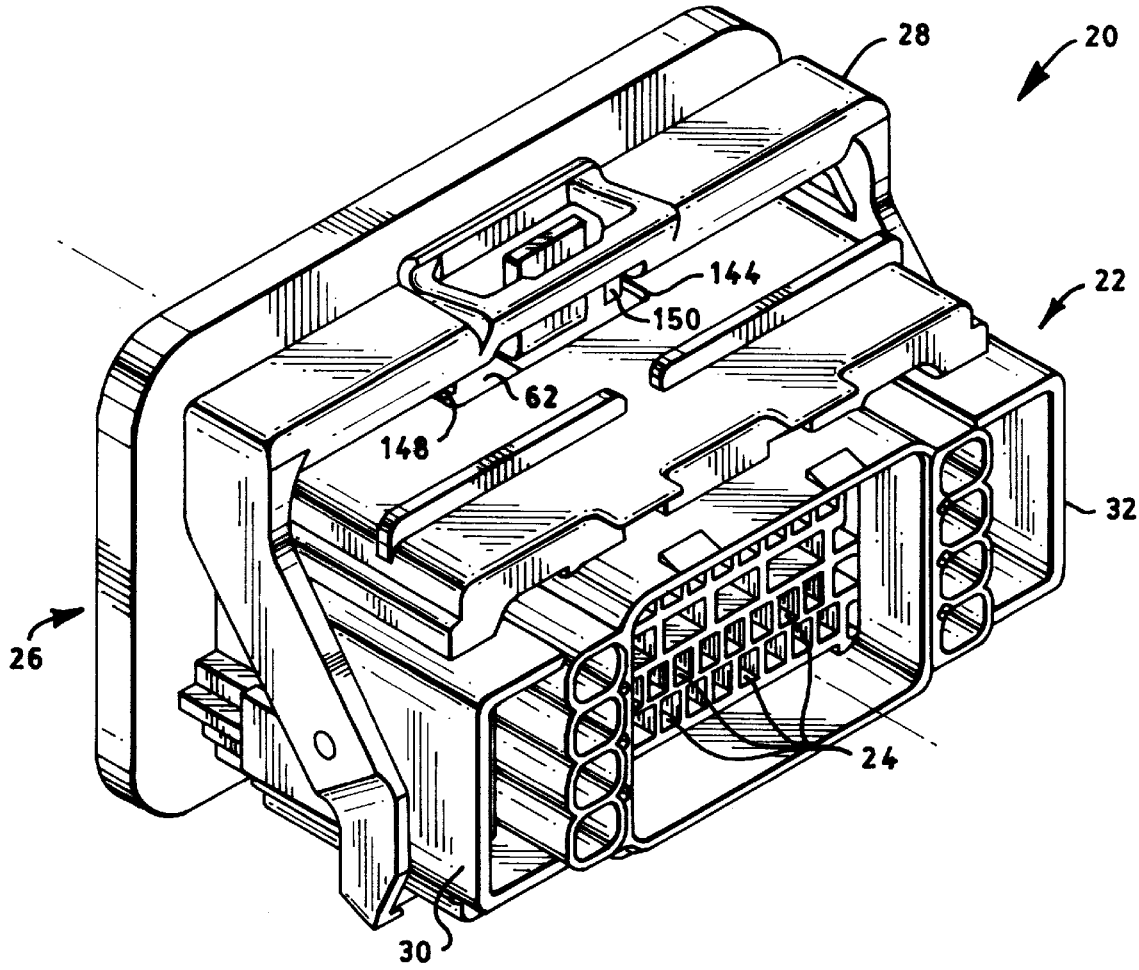
FIG. 1 is an a perspective view of one embodiment of the connector assembly of the present invention.

For a better understanding of the present invention, together with other and further objects, advantages and capabilities thereof, reference is made to the following disclosure and appended claims taken in conjunction with the above-described drawings.

The connector assembly of the present invention includes at least one first connector housing and at least one second connector housing slidably engaging the respective first connector housing. Each first connector housing supports a lever for urging such first connector housing and a mating second connector housing towards and away from each other, as desired. For example, in the embodiment illustrated in FIG. 1, a connector assembly 20 is provided. Without limitation, connector assembly 20 may be of the type used in automobile wiring systems wherein a bundle of wires forming a conventional wiring harness is electrically and mechanically connected to respective contacts housed in a harness connector housing which is adapted for connection to a header connector housing. The header connector housing houses contacts which mate with the contacts in the harness connector housing when the harness and header connector housings are mated with each other. In the embodiment illustrated in FIG. 1, the connector assembly 20 includes a harness connector housing 22 which includes a plurality of openings 24 structured and arranged to contain respective male or female contacts (not shown) electrically and mechanically connected to respective wires of a wiring harness in a conventional manner. A header connector housing 26 is also provided. Like harness connector housing 22, header connector housing 26 includes a plurality of openings (not shown) which contain respective female or male contacts which mate with respective male or female contacts contained within the harness connector housing 22 when the harness and header connector housings are mated with each other as described herein. In one embodiment, the harness and header connector housings 22, 26 may each contain thirty eight contacts on 0.64 mm centers. The friction generated when attempting to connect or disconnect such male and female contacts is sufficiently high to render such task very difficult. To facilitate connection or disconnection, a lever 28 is supported on the harness connector housing 22 for urging the harness and header connector housings 22, 26 towards and away from each, as described herein. The connector assembly 20 is particularly suited to connectors used in a sealed system.

Figure 2:
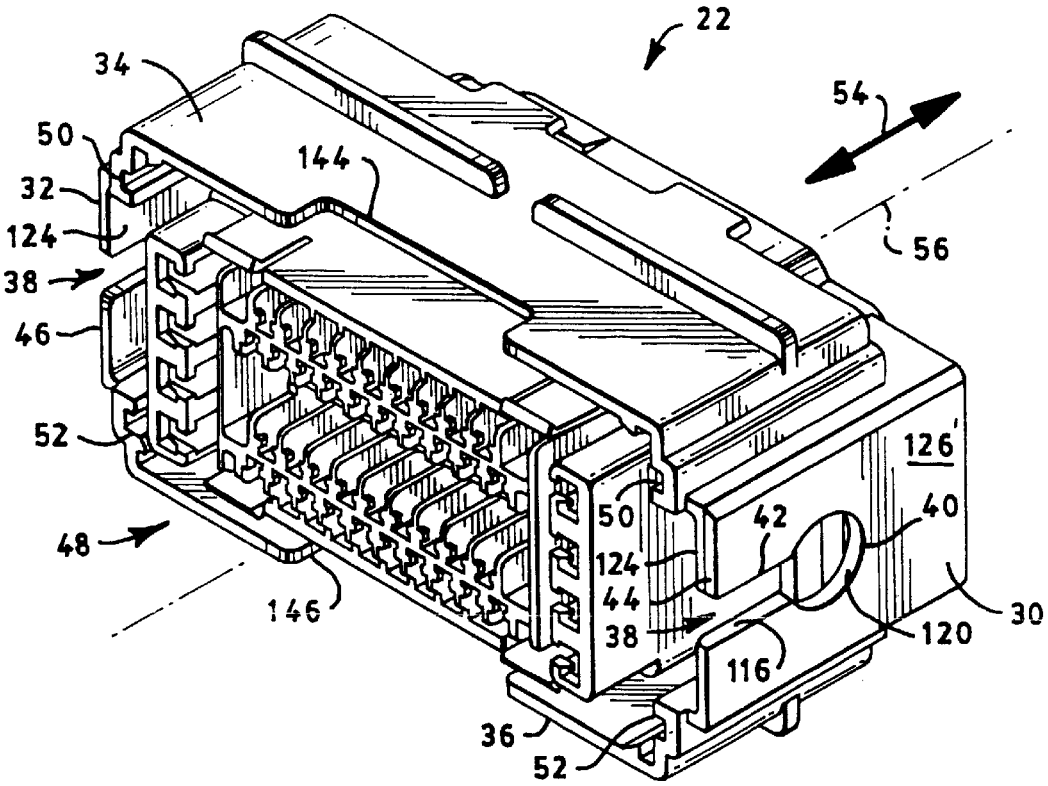
FIG. 2 is a perspective view of a first connector housing of the connector assembly of FIG. 1.

The details of the harness connector housing 22 are illustrated in FIG. 2. Harness connector housing 22 includes opposing sidewalls 30 and 32 and opposing top and bottom walls 34 and 36, respectively. Although not necessary, the harness connector housing 22 is symmetrical and to this end, sidewall 30 is identical to sidewall 32, top wall 34 is identical to bottom wall 36 and the internal features of the housing are symmetrical throughout. As such, the housing 22 may be used as illustrated in FIG. 2 or may be inverted such that wall 34 serves as the bottom wall and wall 36 serves as the top wall.

Sidewalls 30 and 32 each comprise an aperture 38 extending therethrough. Aperture 38 comprises a circular portion 40 which is intersected by a linear portion 42. The width of the linear portion 42 is less than the diameter of the circular portion 40. Linear portion 42 extends from the circular portion 40 to respective edges 44, 46 of sidewalls 30 and 32. The header connector housing 26 is inserted into the harness connector housing 22 at the end 48 of the harness connector housing. To facilitate such insertion as described herein, the harness connector housing 22 comprises two elongated upper grooves 50 and two elongated lower grooves 52 which extend within the harness connector housing in the direction 54 of a longitudinal axis 56 of the harness connector housing.

Figure 3:
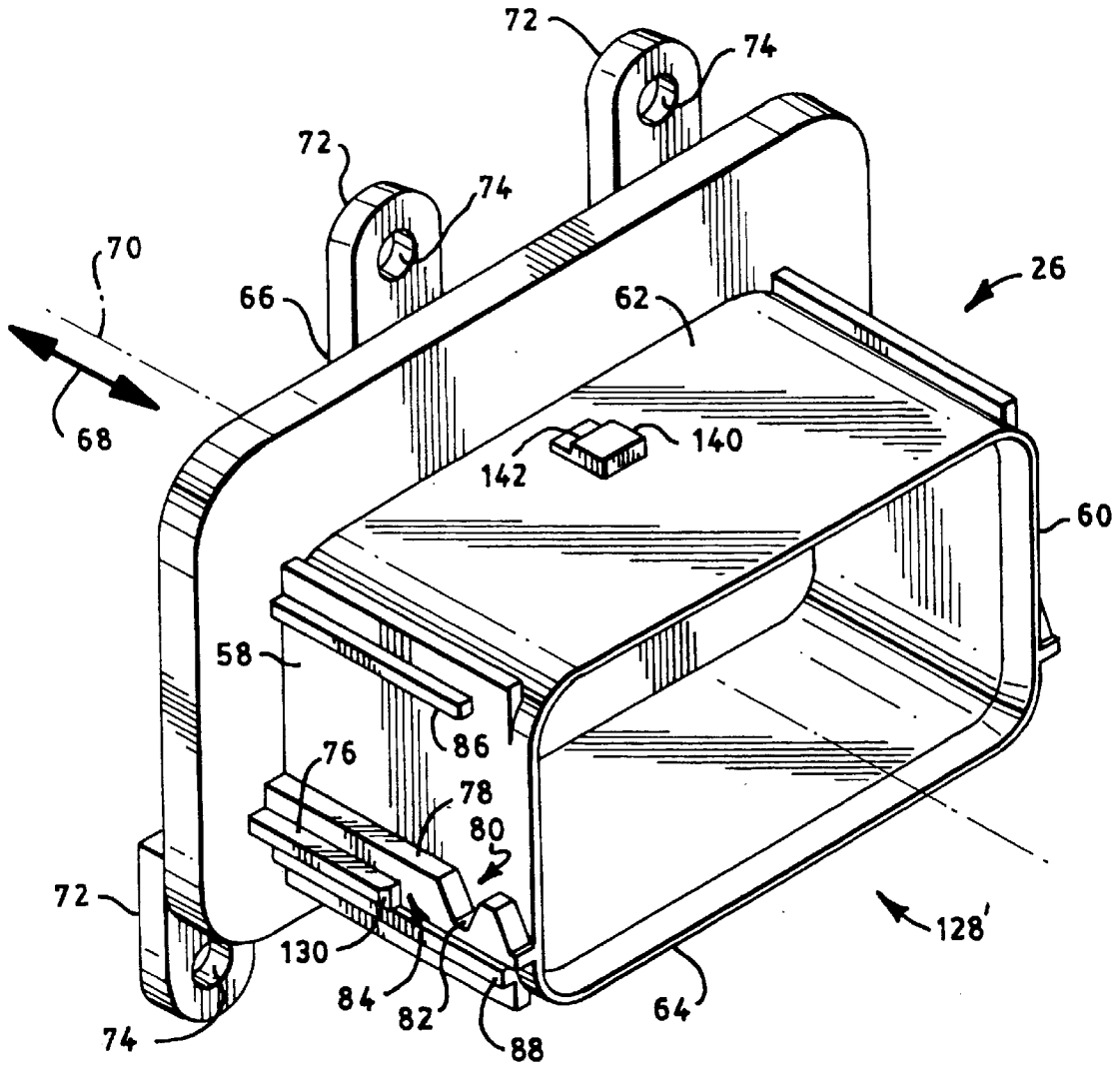
FIG. 3 is a perspective view of a second connector housing of the connector assembly of FIG. 1.

The details of the header connector housing 26 are illustrated in FIG. 3. Header connector housing 26 includes opposing sidewalls 58 and 60 and opposing top and bottom walls 62 and 64. Although the embodiment illustrated in FIG. 3 is not symmetrical throughout, sidewalls 58 and 60 are identical. However, if desired the entire housing 26 may be fabricated to be symmetrical throughout so that, like harness connector housing 22, the header connector housing 26 may be used as illustrated in FIG. 3 or may be inverted such that wall 62 serves as the bottom wall and wall 64 serves as the top wall.

In the embodiment illustrated in FIG. 3, the walls 58, 60, 62 and 64 extend from a mounting plate 66 in the direction 68 of a longitudinal axis 70 of the header connector housing 26. The mounting plate 66 includes a plurality of mounting tabs 72 having respective apertures 74 therethrough. The header connector housing 26 may be mounted to a surface such as an automobile panel by inserting screws through apertures 74 and into the panel in a conventional manner.

The connector assembly 20 may comprise one or more harness connector housings 22 and header connector housing 26. For example, in the embodiment illustrated in FIG. 3, there is one header connector housing 26 extending from the mounting plate 66 to which one harness connector housing 22 may be mated as illustrated in FIG. 1 and described hereinafter. If desired, mounting plate 66 may be elongated sufficiently so that two or more header connector housings 26 may extend therefrom, each having a respective harness connector housing 22 attachable thereto as described herein.

The sidewalls 58 and 60 each comprise a first cam projection 76 and a second cam projection 78. Each cam projection 78 projects from a respective sidewall 58, 60, extends in the direction 68 and comprises a generally V-shaped camming surface area 80 which includes a base portion 82. Each surface area 80 has a gear-like configuration. Each cam projection 76 projects from a respective cam projection 78, extends in the direction 68 and includes a camming surface area 84. The header connector housing 26 comprises elongated upper ribs 86, and elongated lower ribs 88, which extend along the outer surfaces of the sidewalls 58 and 60 in the direction 68. Ribs 86 and 88 are structured and arranged to mate with and slide within grooves 50 and 52, respectively, to facilitate the insertion of the header connector housing 26 into the harness connector housing 22 by facilitating alignment of the two housings when they are mated as described herein.

With reference to FIG. 1, the lever 28 is pivotally supported on the sidewalls 30 and 32 of the harness connector housing 22 by respective first and second pivot elements extending through respective sidewalls 30, 32, as described hereinafter. The details of the lever 28 are illustrated in FIGS. 4 to 7.

Lever 28 comprises opposing first and second resilient arms 90, 92 which are joined by a bridge segment 94. Each arm 90, 92 comprises a pivotal element 96 projecting from a respective inner arm surface 98, 100. Each arm 90, 92 of the lever 28 extends from the bridge segment 94 to a respective distal end which comprises opposing first and second end portions 102. The distance between the end portions 102 is less than the distance between the outer surfaces of the sidewalls 30 and 32.

Each pivotal element 96 comprises a region 104 which includes opposing flat segments 106 connected by opposing circular segments 108. Each pivotal element 96 also comprises a region 110 which includes a cam follower in the form of a generally V-shaped camming surface area 112 which includes a base portion 114. Each surface area 112 has a gear-like configuration and is structured and arranged to mesh with a respective V-shaped camming surface area 80 which projects from sidewalls 58 and 60 of the header connector housing 26.

Figure 8:
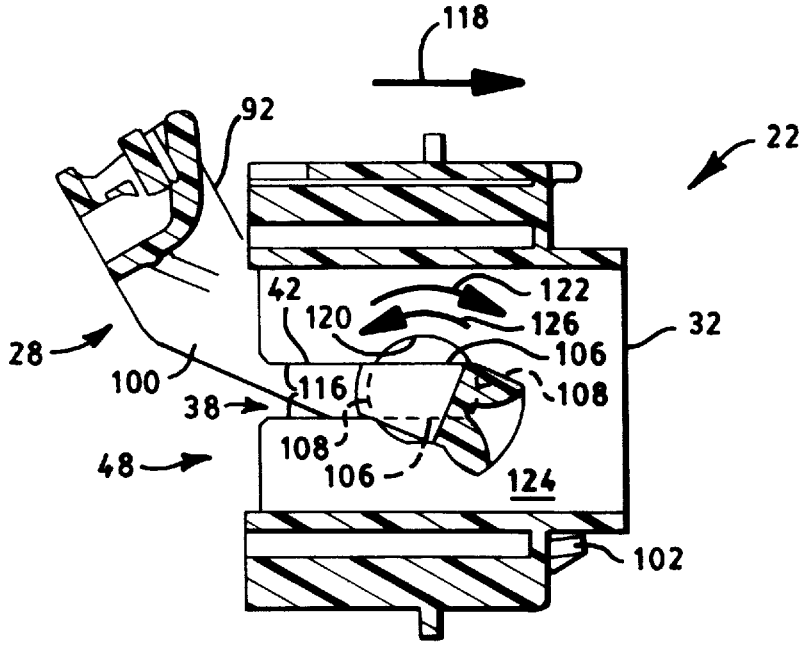
FIGS. 8 and 9 sequentially illustrate attachment of the lever of FIG. 1 to the first connector housing.
Figure 9:
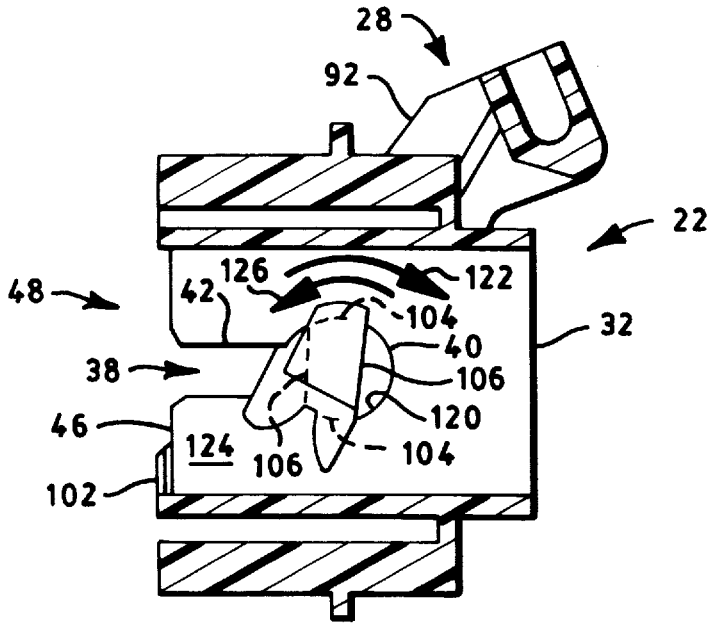

The lever 28 is pivotally supported by sidewalls 30, 32 of the harness connector housing 22 in such a manner that each region 110 of each pivotal element 96 is positioned within the harness connector housing between sidewalls 30, 32, and the arms 90, 92 and bridge segment 94 are positioned outside of the harness connector. To accomplish such structural relationship, the lever 28 is attached to the harness connector 22 in the following manner. With reference to FIGS. 2 and 8, resilient arms 90, 92 are urged apart so that they engage and bear against the outer surface of sidewalls 30 and 32. The distance between the end portions 102 relative to the distance between the outer surfaces of the sidewalls 30, 32 is dimensioned such that the arms 90, 92 do not require a great deal of deflection to be caused to bear against the sidewalls. The region 104 of each pivotal element 96 is then inserted into a respective aperture 38 in sidewalls 30, 32 such that opposing flat segments 106 mate with the opposing edges 116 of the linear portion 42 of aperture 38. The region 104 is caused to slide along the linear portion 42 in direction 118 until a circular segment 108 of the region 104 engages the wall 120 of the circular portion 40 of the aperture 38 as illustrated in FIG. 8. The lever 28 is then rotated in a disengagement direction 122, the opposing circular segments 108 engaging the wall 120 during such rotation, as illustrated in FIG. 9. Such movement of the lever 28 rotates each region 104 within a respective circular portion 40 of a respective aperture 38. Each region 110 will be disposed inside of the harness connector housing 22 adjacent an inner surface 124 of a respective wall 30, 32, and the lever arms 90, 92 will be disposed outside of the harness connector housing adjacent an outer surface 126' of a respective wall 30, 32. The lever 28 is rotated in direction 122 until the end portions 102 engage respective edges 44 and 46 of sidewalls 30 and 32 as illustrated in FIG. 9 with respect to end portion 102 of lever arm 92. When the end portions 102 engage respective sidewalls 30, 32 in this manner, the lever will be in a first lever position wherein pivotal movement of the lever will be prevented. In particular, the abutment of respective end portions 102 against edges 44 and 46, respectively, will prevent rotation of the lever 28. As a practical matter, the lever 28 will be prevented from rotating until the header and harness connector housings engage each other as described herein. The lever 28 and harness connector housing 22 are now pre-assembled and ready for attachment to the header connector housing 26. It should be noted that the bridge segment 94 of lever 28 is near the rear of the harness connector housing 22.

The harness and header connector housings 22 and 26 are mated together by inserting the end 128' of the header connector housing into the end 48 of the harness connector housing. To this end, ribs 86 and 88 are inserted into respective grooves 50 and 52 to properly align the housings 22, 26. As the housing 26 is inserted into the housing 22, the camming surface areas 84 engage respective end portions 102 and urge such end portions apart in a second lever position. In particular, the end portions 102 are sufficiently disengaged from the opposing sidewalls 30, 32 by the camming surface areas 84 of the cam projections 76 to permit the end portions 102 to clear the edges 44 and 46 sufficiently to permit pivotal movement of the lever 28 in an engagement direction 126.

Figure 12:
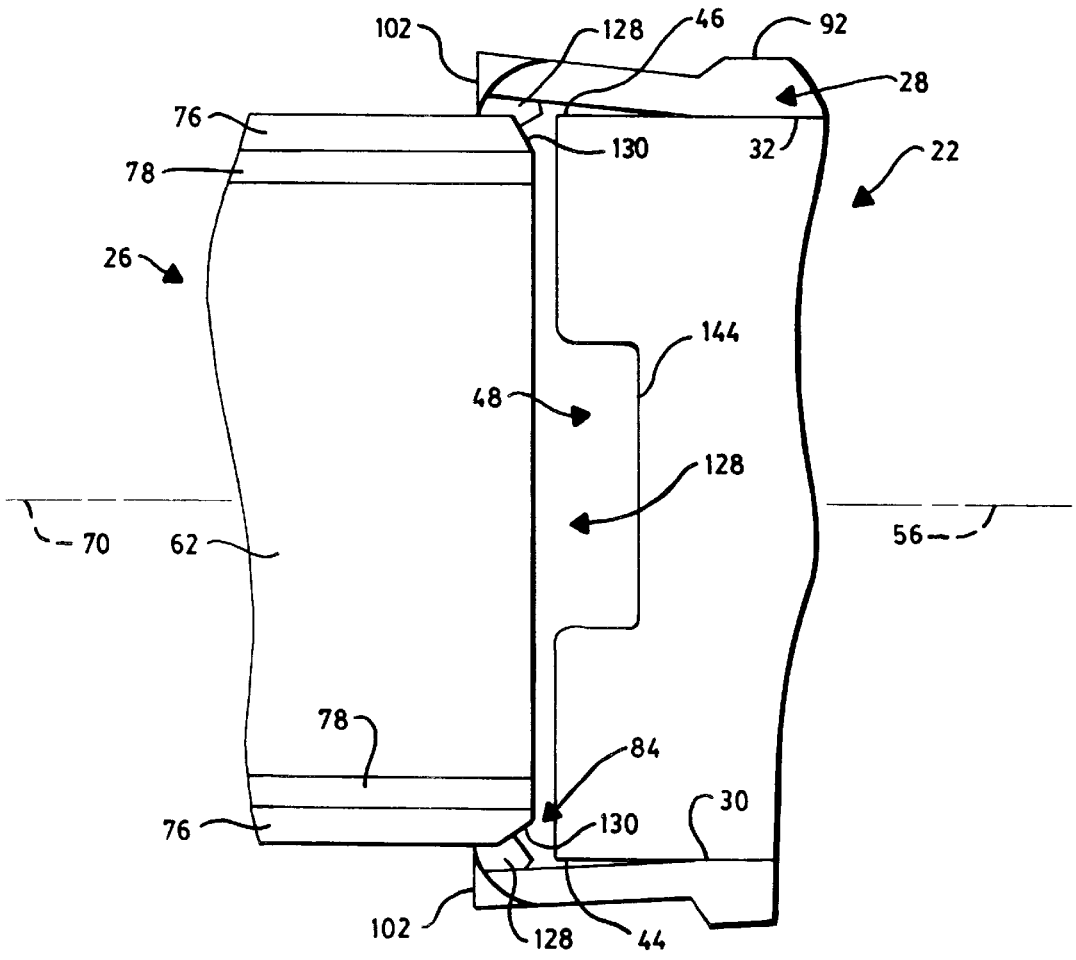
FIG. 12 is a partial plan view of the first and second connector housings during the mating thereof.

With reference to FIG. 12, in order to facilitate the movement of the end portions 102 away from each other, each end portion may comprise a beveled surface 128, and each camming surface area 84 may comprise a beveled surface 130. In such an embodiment, when the housing 26 is inserted into housing 22, each beveled surface 128 slides upon a respective beveled surface 130 causing end portions 102 to be cammed away from each other. It will be noted that in the embodiment illustrated in the drawings, when the harness and header connector housings 22, 26 are being urged together, the axes 56 and 70 will be coincident, and the end portions 102 will be cammed away from such axes.

Figure 10:
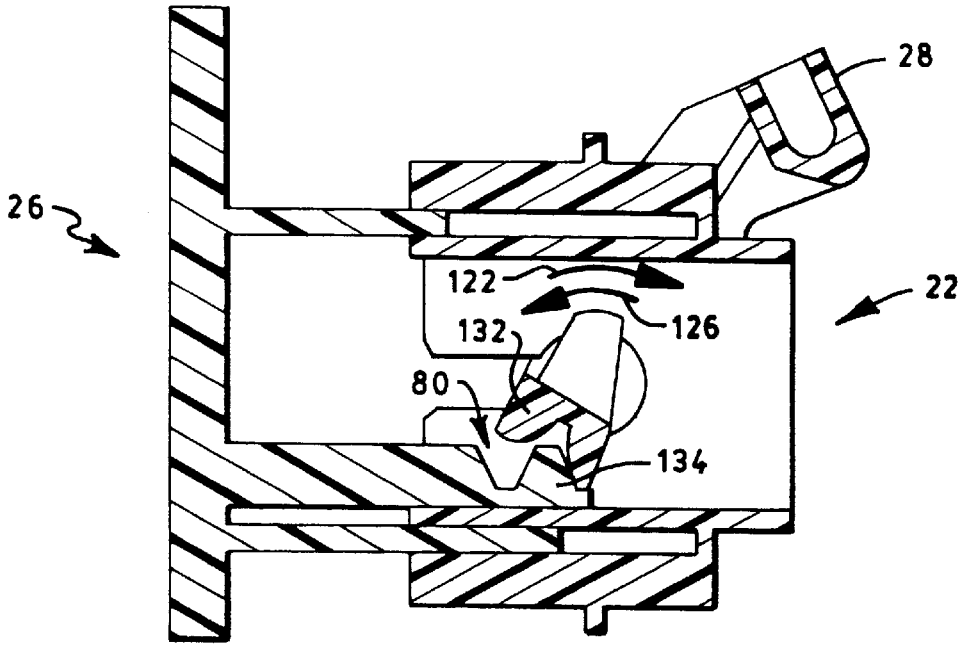
FIGS. 10 and 11 sequentially illustrate engagement/disengagement of the first connector housing of FIG. 1 relative to the second connector housing.
Figure 11:
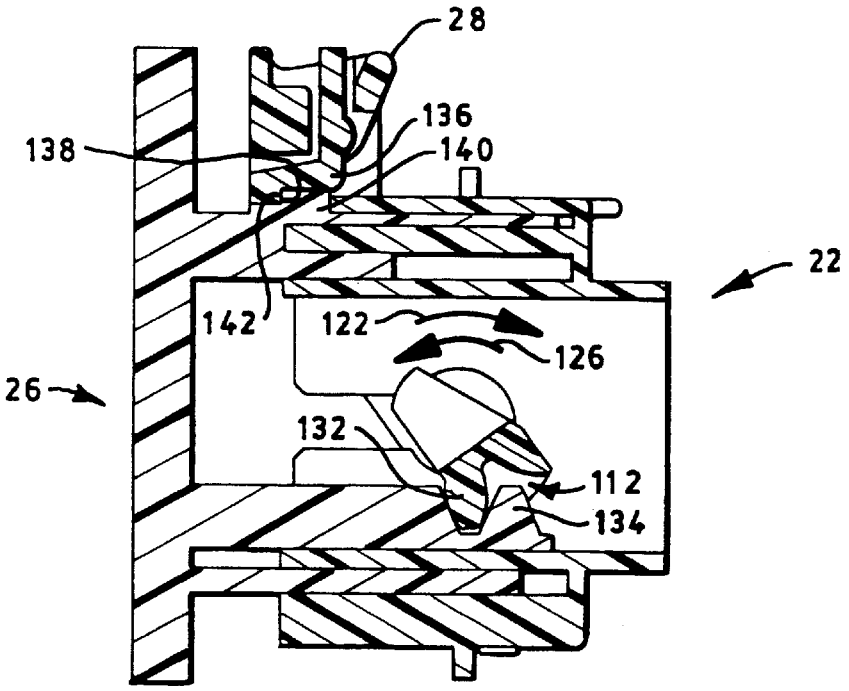

The cam followers in the form of the generally V-shaped gear-like surface area 112 are adapted to engage respective generally V-shaped gear-like camming surface areas 80 of the cam projection 78 so that by pivotal operation of the lever 28 the harness and header connector housings 22 and 26 will be urged towards or away from each other when the lever is pivoted in an engagement direction towards the header connector or in a disengagement direction away from the header connector. For example, after the end portions 102 have been cammed away from each other by respective camming surface areas 84, the harness connector housing can be partially pushed towards the header connector housing causing the lever 28 to rotate sufficiently in direction 126 to alert the user that the lever may be engaged. Such rotation causes each surface area 112 of lever 28 to begin to mesh or mate with a respective surface area 80 of the header connector housing 26 as illustrated in FIG. 10. The user next continues rotation of the lever 28 by pushing against the bridge segment 94. Since bridge segment 94 is near the rear of the harness connector housing 22, the lever and harness connector housing move in the same general direction during this step. Such continued rotation of lever 28 in direction 126 causes the tooth 132 to fully mesh with a respective camming surface area 80. During such rotation, the interaction between each tooth 132 and a respective camming surface area 80 urges the harness and header connector housings 22, 26 together as illustrated in FIG. 11. When the lever can no longer be rotated in direction 126, the contacts in the respective housings will be fully mated in a conventional manner.

If it is desired to disconnect the housings 22 and 26, the lever is rotated in direction 122. Such rotation causes each tooth 134 of each respective camming surface area 80 to fully mesh with a respective surface area 112. During such rotation, the interaction between each tooth 134 and a respective surface area 112 urges the harness and header connector housings 22, 26 apart as illustrated in FIG. 10. The end portions 102 of arms 90, 92 prevent the lever 28 from pivoting sufficiently in direction 122 to its pre-assembled position where the end portions 102 engage respective edges 44 and 46.

Figure 4:
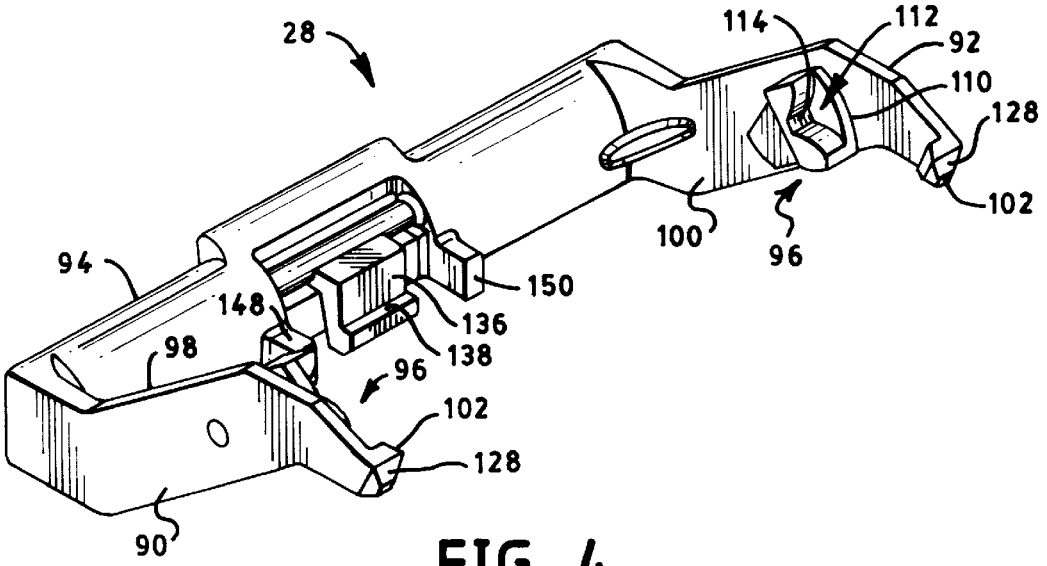
FIG. 4 is a top perspective view of the lever illustrated in FIG. 1.
Figure 5:
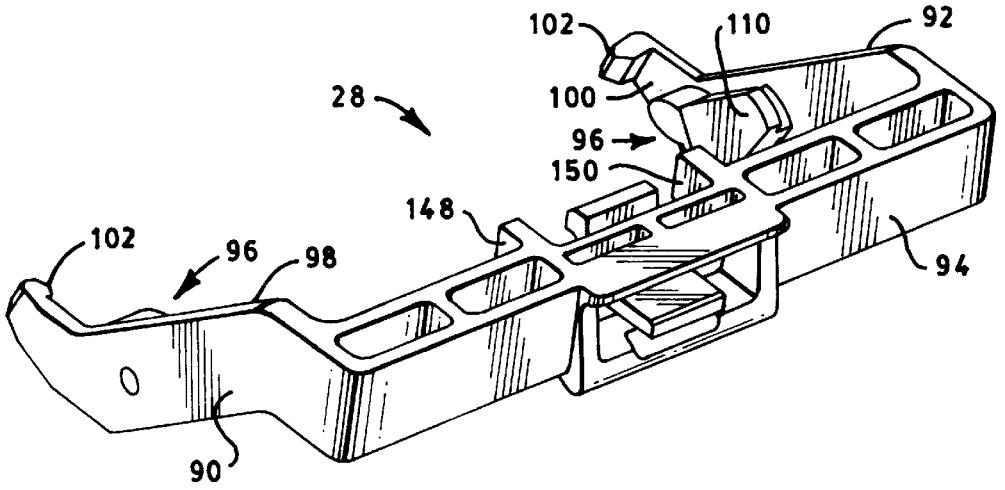
FIG. 5 is a bottom perspective view of the lever illustrated in FIG. 1.
Figure 6:
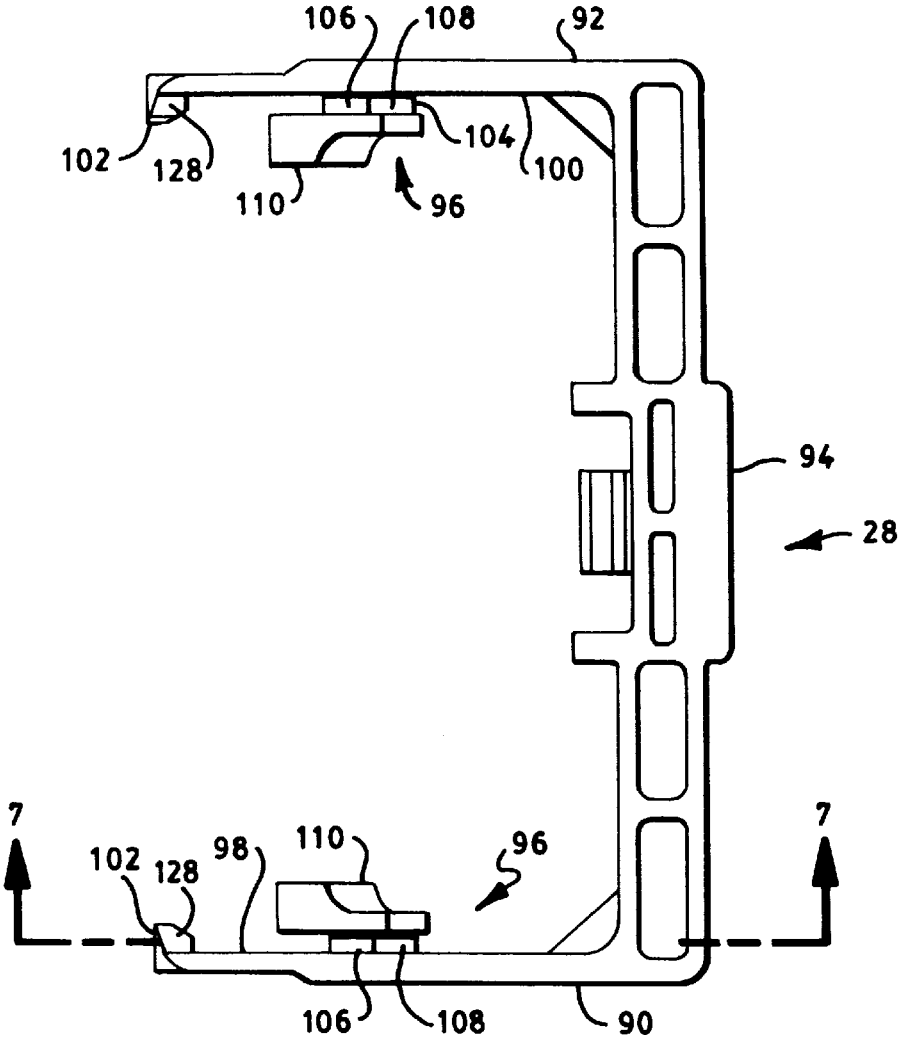
FIG. 6 is a top view of the lever of FIGS. 4 and 5.
Figure 7:
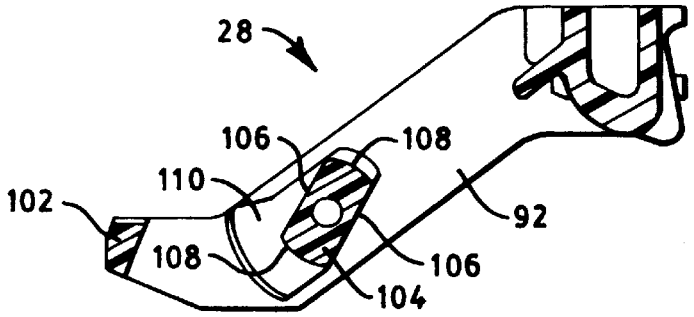
FIG. 7 is a sectional view of FIG. 6 taken along lines 7—7.

With reference to FIGS. 4 and 5, the bridge segment 94 of the lever 28 comprises a resilient latch member 136 including an engagement surface 138. With reference to FIG. 3, the top wall 62 of the header connector housing 26 comprises a mating latch member 140 including a mating engagement surface 142. The latch member 136 and mating latch member 140 are structured and arranged to fully engage each other, when the connector housings 22, 26 are fully engaged, to thereby lock the connector housings in place relative to each other. In particular, with reference to FIG. 11, the resilient latch member 136 will snap into place relative to the mating latch member 140 so that the engagement surface 138 engages the mating engagement surface 142 when the contacts of the connector housings 22 and 26 are engaged sufficiently to assure proper electrical connection. When the latch member 136 and mating latch member 140 snap together, the engagement surface 138 will bear against the mating engagement surface 142. The latch member 136 may be disengaged so that the lever 28 may be rotated in direction 122 by depressing the latch member so that the surface 138 disengages surface 142.

In the embodiment illustrated in FIG. 2, the top and bottom walls 34 and 36 of the harness connector housing 22 include recesses 144 and 146 adjacent end 48. With reference to FIGS. 4 and 5, the bridge segment 94 of the lever 28 comprises first and second beams 148 and 150 which extend from the bridge segment. The beams 148 and 150 are structured and arranged such that when the connector housings 22 and 26 are fully engaged, the distal ends of the beams will extend into the recess 144 and engage the top wall 62 of the connector housing 26 as illustrated in FIG. 1. Such beams prevent the bridge segment 94 of the lever 28 from being forced into engagement with the latch 136 when a plurality of connector housings 20 are stacked upon each other. As a result, the latch 136 is isolated from tolerance stackup problems.

Fabrication of the connector assembly of the present invention may be accomplished using conventional procedures. For example, the connector housings 22 and 26 and the lever 28 may be molded from a plastic material.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A connector assembly, comprising:

at least one first connector housing comprising opposing first and second sidewalls;

at least one second connector housing comprising opposing third and fourth sidewalls, said third and fourth sidewalls slidably engaging within said first and second sidewalls, said third and fourth sidewalls each comprising first and second cam projections; and a lever pivotally supported on said first and second sidewalls by respective first and second pivot elements extending through said first and second sidewalls, respectively, said lever comprising first and second lever portions adapted (a) to engage said opposing first and second sidewalls, respectively, in a first lever position to prevent pivotal movement of said lever, and (b) to be disengaged from said opposing first and second sidewalls by a respective of said first cam projections in a second lever position to permit pivotal movement of said lever, said first and second pivot elements each comprising a first region which comprises a cam follower, each cam follower being adapted to engage a respective of said second cam projections in an engagement and disengagement mode when said lever is pivoted in an engagement direction or in an opposite disengagement direction, respectively, to urge said first and second connector housings towards or away from each other, respectively.

2. The connector assembly of claim 1 further comprising a mounting plate, said at least one second connector housing extending from said mounting plate.

3. The connector assembly of claim 1 wherein said first and second sidewalls each comprise an aperture extending therethrough, said aperture comprising a circular portion intersected by a linear portion which extends to an edge of said sidewall, and further wherein said first and second pivotal elements each comprise a second region which comprises opposing flat segments connected by opposing circular segments, said opposing flat segments structured and arranged to mate with said linear portion for attaching said lever to said first connector, and said opposing circular segment structured and arranged to mate with said circular portion for pivoting said lever relative to said first connector.

4. The connector assembly of claim 3 wherein each cam follower comprises a generally V-shaped first surface area, and each second cam projection comprises a generally V-shaped second surface area.

5. The connector assembly of claim 3 wherein said lever comprises opposing resilient first and second arms joined by a bridge segment, said first and second arms and said bridge segment being positioned outside of said first connector housing, and said first and second pivotal elements projecting from said first and second arms, respectively.

6. The connector assembly of claim 5 wherein said first arm extends from said bridge segment to a first distal end, and said second arm extends from said bridge segment to a second distal end, said first and second distal ends comprising said first and second lever portions.

7. The connector assembly of claim 6 wherein said first and second lever portions engage an edge of a respective of said first and second sidewalls.

8. The connector assembly of claim 7 wherein said first and second lever portions each comprise a beveled surface.

9. The connector assembly of claim 5 wherein said bridge segment comprises a latch member, and said second connector housing comprises a mating latch member, said latch member being structured and arranged to fully engage said mating latch member when said first and second connector housings are fully engaged.

10. The connector assembly of claim 9 further comprising first and second beams extending from said bridge segment, said latch member being positioned between said first and second beams, said first and second beams being structured and arranged to engage said top surface of said second connector housing when said first and second connector housings are fully engaged.

11. The connector assembly of claim 5 wherein each first region is positioned within said first connector housing between said first and second sidewalls, and each second region is positioned within a respective of said apertures.

12. The connector assembly of claim 11 further comprising a mounting plate, said at least one second connector housing extending from said mounting plate.

13. A connector assembly, comprising:

a mounting plate;

two first connector housings each comprising opposing first and second sidewalls;

two second connector housings each extending from said mounting plate and comprising opposing third and fourth sidewalls, said third and fourth sidewalls slidably engaging within respective first and second sidewalls of respective first connector housings, said third and fourth sidewalls each comprising first and second cam projections; and a first and second lever each pivotally supported on a respective of said first connector housings on said first and second sidewalls by respective first and second pivot elements extending through said first and second sidewalls, respectively, said first and second levers each comprising first and second lever portions adapted (a) to engage a respective of said opposing first and second sidewalls, in one lever position to prevent pivotal movement of a respective of said levers, and (b) to be disengaged from a respective of said first and second opposing sidewalls by a respective of said first cam projections in another lever position to permit pivotal movement of a respective of said levers, said first and second pivot elements each comprising a first region which comprises a cam follower, each cam follower being adapted to engage a respective of said second cam projections in an engagement and disengagement mode when a respective of said levers is pivoted in an engagement direction or in an opposite disengagement direction, respectively, to urge a respective of said first and second connector housings towards or away from each other, respectively.

14. The connector assembly of claim 13 wherein said first and second sidewalls each comprise an aperture extending therethrough, said aperture comprising a circular portion intersected by a linear portion which extends to an edge of the sidewall, and further wherein said first and second pivotal elements each comprise a second region which comprises opposing flat segments connected by opposing circular segments, said opposing flat segments structured and arranged to mate with said linear portion for attaching a respective of said levers to a respective of said first connectors, and said opposing circular segment structured and arranged to mate with said circular portion for pivoting said respective lever relative to said respective first connector.

15. The connector assembly of claim 14 wherein each cam follower comprises a generally V-shaped first surface area, and each second cam projection comprises a generally V-shaped second surface area.

16. The connector assembly of claim 14 wherein each lever comprises opposing resilient first and second arms joined by a bridge segment, said first and second arms and said bridge segment being positioned outside of a respective of said first connector housings, and said first and second pivotal elements projecting from said first and second arms, respectively.

17. The connector assembly of claim 16 wherein each first region is positioned within a respective of said first connector housing between said first and second sidewalls, and each second region is positioned within a respective of said apertures.

18. The connector assembly of claim 17 wherein said first arm extends from said bridge segment to a first distal end, and said second arm extends from said bridge segment to a second distal end, said first and second distal ends comprising said first and second lever portions.

19. The connector assembly of claim 18 wherein respective of said first and second lever portions engage respective edges of respective of said first and second sidewalls.

20. A connector assembly, comprising:

at least one first connector housing;

at least one second connector housing slidably engaging within said first connector housing, said second connector housing comprising first and second cam projections; and a lever pivotally supported on said first connector housing by at least one pivot element extending through a wall of said first connector housing, said lever comprising at least one lever portion adapted (a) to engage said wall of said first connector housing in a first lever position to prevent pivotal movement of said lever, and (b) to be disengaged from said wall of said first connector housing by said first cam projection in a second lever position to permit pivotal movement of said lever, said pivot element comprising a first region which comprises a cam follower adapted to engage said second cam projection in engagement and disengagement modes when said lever is pivoted in an engagement direction or in an opposite disengagement direction, respectively, to urge said first and second connector housings towards or away from each other, respectively.

* * * * *